United States Patent [19]

Ito et al.

[11] 4,034,725

[45] July 12, 1977

[54] ELECTRIC GOVERNOR

[75] Inventors: Osamu Ito, Toyota; Nobuhito Hobo, Inuyama; Yoshihiko Tsuzuki, Anjo; Michio Iyoda, Aichi, all of Japan

[73] Assignee: Nippondenso Co., Ltd., Kariya, Japan

[21] Appl. No.: 632,178

[22] Filed: Nov. 14, 1975

[30] Foreign Application Priority Data

Nov. 28, 1974 Japan ..... 49-137286

[51] Int. Cl.[2] ..... F02D 1/04; F02P 9/00

[52] U.S. Cl. ..... 123/102; 180/105 E; 307/232; 318/206 R

[58] Field of Search ..... 123/102; 180/105 E; 307/232, 233; 290/40 A, 40 E; 318/206, 207, 208

[56] References Cited

U.S. PATENT DOCUMENTS

| | | | |
|---|---|---|---|
| 3,585,400 | 6/1971 | Brayton | 307/233 |
| 3,724,433 | 4/1973 | Voss | 123/102 |
| 3,820,624 | 6/1974 | Sakakibara | 180/105 E |

*Primary Examiner*—C. J. Husar
*Assistant Examiner*—Ronald B. Cox
*Attorney, Agent, or Firm*—Cushman, Darby & Cushman

[57] ABSTRACT

An electric governor for an internal combustion engine comprises an engine speed sensor, a phase shifter, a twin-T type filter and a multiplier for multiplying outputs of the phase shifter and the twin-T type filter. The twin-T type filter is arranged to vary its gain and phase in response to the difference between the peculiar frequency thereof and the frequency of the speed signal, whereby the multiplied outputs varies its amplitude and polarity in response to the frequency difference. A servo motor which is adapted to control the engine speed control mechanism is connected to the multiplier, so that the engine can be controlled to run at a predetermined speed which corresponds to the peculiar frequency of the twin-T type filter.

3 Claims, 12 Drawing Figures

ELECTRIC GOVERNOR

BACKGROUND OF THE INVENTION

This invention relates to an improvement in an electric governor in which an engine rotational speed is electrically detected to have a speed deviation with respect to a preset speed, in response to which a servo motor is controlled to operate an engine speed control mechanism.

SUMMARY OF THE INVENTION

It is a primary object of the present invention to provide a simple and reliable electric governor.

It is another object of the present invention to provide a compact electric governor which comprises means for shifting the phase of an speed signal, a filter circuit having a peculiar frequency and means for multiplying the outputs of above said two means.

Other objects and features of the present invention will be apparent in the following specification and drawings.

DETAILED DESCRIPTION OF THE PREFERRED EMBODIMENT

Figure 1:
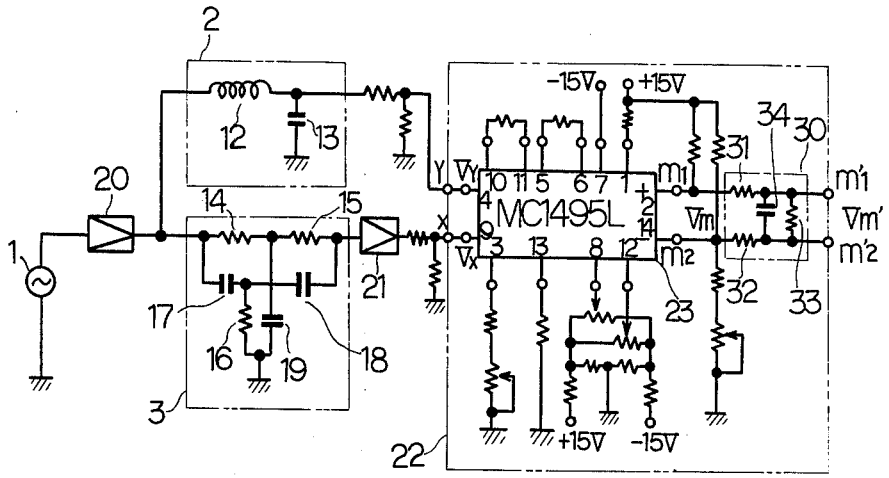
FIG. 1 is an electric wiring diagram of a deviation detector of the electric governor according to the present invention, FIGS. 2 and 3 respectively show output gain and phase characteristics of the twin-T type filter of the embodiment shown in FIG. 1.

In FIG. 1 showing a deviation detector of the electric governor according to the present invention, an engine rotational speed detector 1 such as tacho generator linked with an engine cranckshaft generates a speed signal with the frequency proportional to engine rotational speed. A phase shifter 2 which comprises an inductor 12 and a capacitor 13 is connected to the speed detector 1 through an amplifier 20. The phase shifter 2 retards the phase of the speed signal by 90 degrees in the electric phase angle. A twin-T type filter 3 which comprises resistors 14, 15 and 16 and capacitors 17, 18 and 19 is further connected to the speed detector 1 through the amplifier 20. Assuming that each resistance value of resistors 14, 15 and 16 is respectively R, $m \cdot R$ and $p \cdot R$ and that each capacitance value of capacitors 17, 18 and 19 is respectively C, $C/n$ and $C/q$; then the matching condition of the twin-T type filter 3 is given as follows:

$$p = \frac{m}{1+n} \qquad \text{(a)}$$

-continued $$q = \frac{n}{1+m} \qquad \text{(b)}$$

The matching frequency fo is also given as follows:

$$fo = \frac{1}{2\pi CR}\sqrt{\frac{n(n+1)}{m(m+1)}} \qquad \text{(c)}$$

Figure 2:
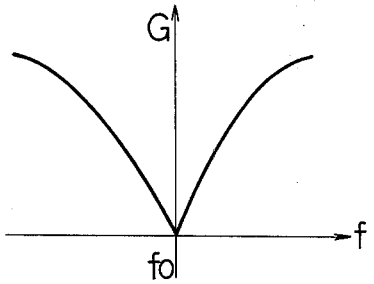
Figure 3:
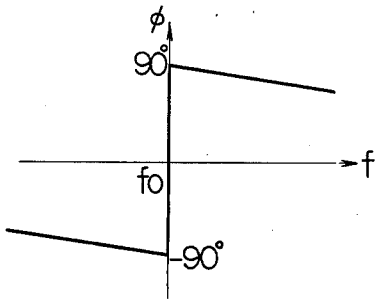

When a sine wave input signal with its frequency $f$ and amplitude $Ei$ is applied to the twin-T type filter 3, the output gain G which is defined by the ratio of the output signal voltage Eo to the input signal voltage Ei thereof and the phase difference $\phi$ which is the phase difference between the input signal and output signal thereof are respectively shown in FIGS. 2 and 3.

The matching frequency fo is arranged to correspond to a preset engine rotational speed by selecting the circuit elements. It is noted that the gain G becomes minimum and the phase difference $\phi$ turns over from −90° to 90° or vice versa at the frequency $fo$.

Figure 4:
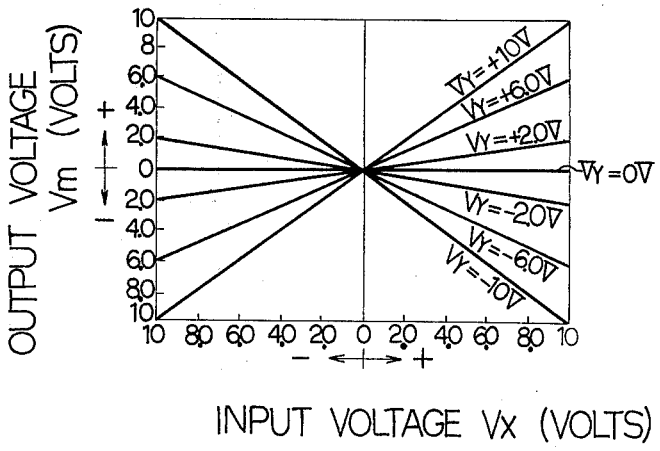
FIG. 4 is a graph showing output characteristics of the multiplying circuit of the embodiment shown in FIG. 1, FIGS. 5(*a*), (*b*), (*c*) and (*d*) respectively show wave forms of signals appearing at various parts of the embodiment shown in FIG. 1.

A multiplier 22 which comprises an analog multiplier such as obtained in the trade name MC 1495 L of Motorola Semiconductor Products Inc. is connected to the phase shifter 2 and, through an amplifier 21, to the twin-T type filter 3 respectively at its input terminals X and Y. The multiplier provides the output signal voltage Vm which is proportional to the product of the respective input signal voltages V$x$ and V$y$ at its output terminals $m1$ and $m2$. The relation between the output signal voltage V$m$ and the input signal voltages V$x$ and V$y$ is expressed as follows:

$Vm = K \cdot Vx \cdot Vy$, where $K$ is a scale factor defined by external circuit elements. FIG. 4 shows the above relationship in the case $K = 1/10$.

Figure 5:
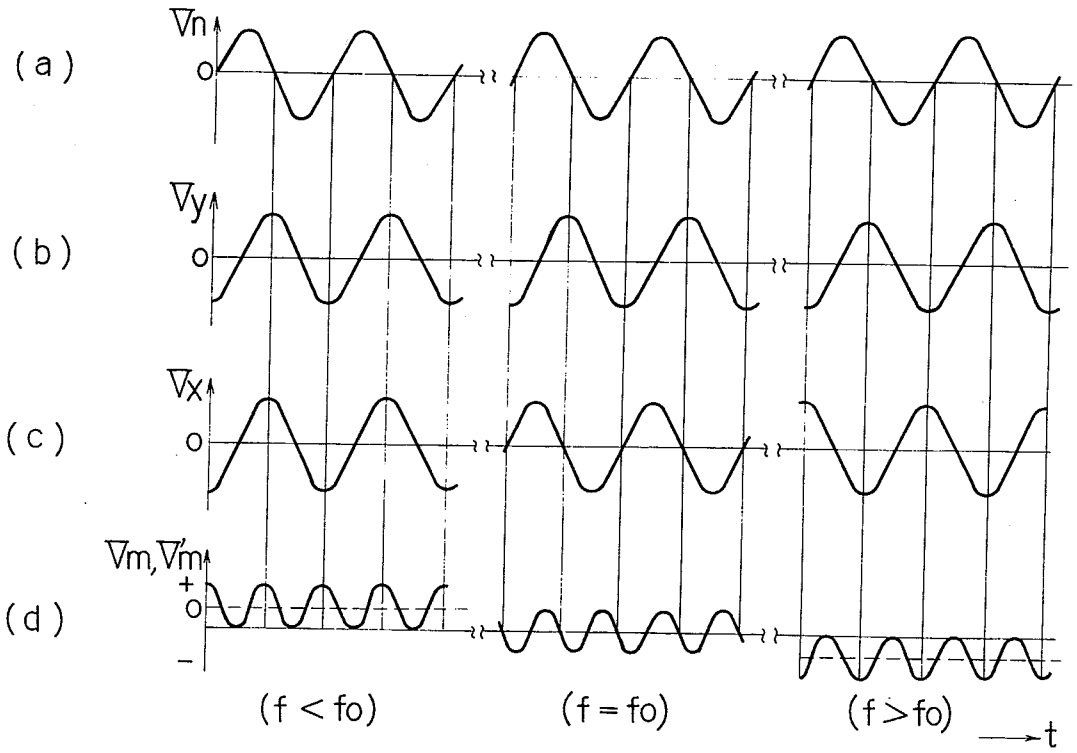

A smoothing circuit 30 including resistors 31, 32 and 33, a capacitor 34 provides an output signal $Vm'$ which is a smoothed signal of the multiplied signal $Vm$. FIGS. 5(*a*), (*b*), (*c*) and (*d*) show the phase relationships between an input engine rotational speed signal $Vn$, the multiplier input signals $Vx$ and $Vy$ and the multiplier output signal $Vm$. The smoothed output signal $Vm'$ is also shown in dotted lines. In these FIGURES, the abscissa represents time, on which each signal wave of each FIGURE at same position corresponds to the same time sequence. The left side FIGURES show each signal wave appearing when the frequency $f$ of the engine rotational speed signal $BVh$ is smaller than the matching frequency $fo$. It is noted in the above that the smoothed output voltage $Vm'$ is positive.

The middle FIGURES show same signal waves appearing when the frequency $f$ is equal to $fo$. In this condition, the smoothed output voltage $Vm'$ is zero.

The right FIGURES are in the case $f$ is larger than $fo$, where $Vm'$ is negative.

Figure 6:
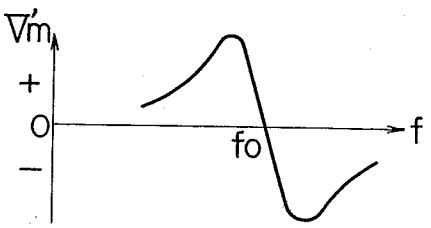
FIG. 6 is a graph showing a characteristic curve of the output signal of the embodiment shown in FIG. 1.

As described before, the gain G of the twin-T type filter changes as its input frequency $f$ changes, and therefore, if the input signal $Vn$ with a constant amplitude is applied thereto, the smoothed output voltage $Vm'$ varies with its frequency as shown in FIG. 6. It is noted in this FIGURE that voltage of the smoothed output signal $Vm'$ reverses itself with respect to the matching frequency $fo$, and, as a result, the deviation of the actual engine rotational speed from the predetermined rotational engine speed is detected.

Figure 7:
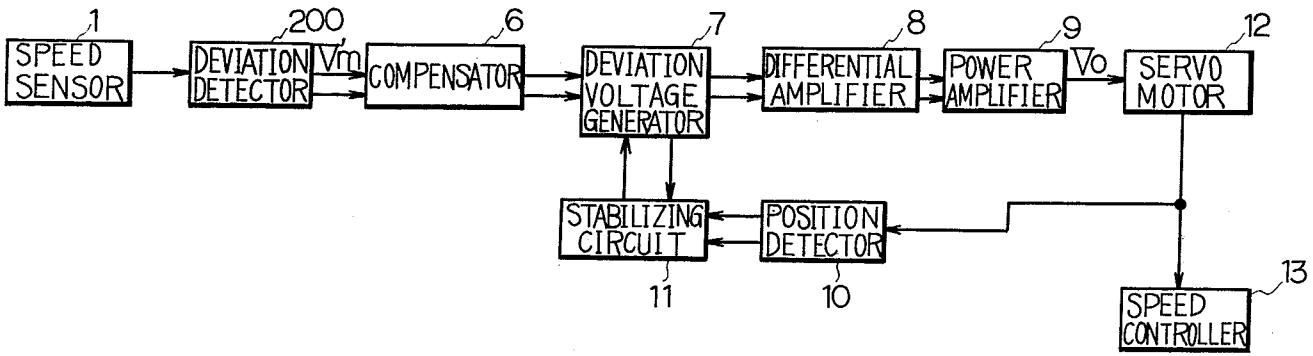
FIG. 7 is a block diagram of the electric governor according to the present invention.

An embodiment of the electric governor according to the present invention will be explained with reference to FIG. 7.

A speed sensor 1 for generating an engine rotational speed signal whose frequency is proportional to the engine rotational speed is connected to the deviation detector 200 previously described. A compensator 6 is connected to the deviation detector 200 for stabilizing the control speed owing to the actual engine speed fluctuation by advancing and retarding the input signals thereon. A position detector 10 is mounted on an engine to detect position of a speed controller 13 which corresponds to actual control amount. A stabilizing circuit 11 is connected between the position detector 10 and the deviation detector 7 to suppress the fluctuation of controlled engine speed. A deviation voltage generator 7 generates a signal in accordance with the difference between the output voltage of the compensator and that of the stabilizing circuit 11. A differential amplifier 8 generates a pair of driving signals with the phases opposite each other in response to the output of the deviation voltage generator 7. A power amplifier 9 amplifies the pair of driving signals to drive a servo motor 12 which, in turn, drives the speed controller 13. The speed controller 13 can be a fuel supply means such as a fuel injection pump in the case of a diesel engine and a throttle valve in the case of a gasoline engine.

Figure 8:
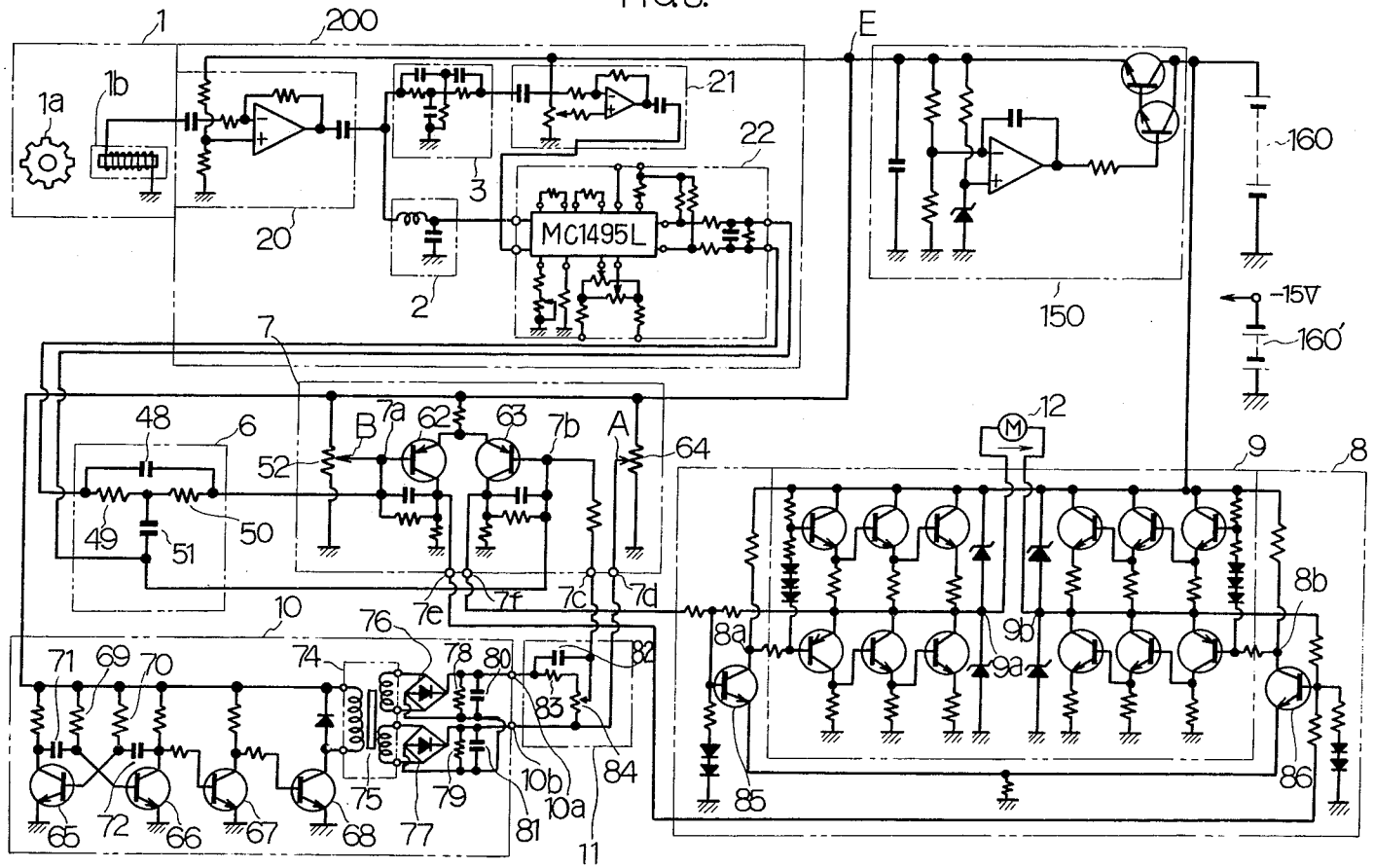
FIG. 8 is a circuit diagram of a preferred embodiment of the electric governor according to the present invention.

In FIG. 8, a preferred embodiment of the electric governor for controlling the rotational speed of a diesel engine according to the present invention is shown.

The speed sensor 1 comprises a gear 1*a* of magnetic material secured to a cam shaft of a fuel injection pump and an electromagnetic pick-up lb with a magnet and a coil wound therearound. The deviation detector 200 has been previously explained. The compensator 6 comprises resistors 49 and 50 and capacitors 48 and 51. The position detector 10 comprises transistors 65 and 66, resistors 69 and 70, capacitors 71 and 72, forming an astable multivibrator and further transistors 67 and 68, a differential transformer 74 with a moving core linked with a control rack of the fuel injection pump, diode bridge circuits 76 and 77, and a smoothing circuit including resistors 78 and 79 and capacitors 80 and 81. The output of the astable multivibrator is amplified by the transistors 67 and 68 to energize the primary coil of the differential transformer 74. The output voltage of the transformer 74, which responds to the position of the moving core to change as the moving core moves with the movement of the control rack, is rectified by the bridge circuits 76 and 77, and then smoothed by the smoothing circuits 80 and 81, whereby the voltage which corresponds to the position of controller or the control amount is obtained.

The stabilizing circuit 11 comprises a capacitor 82, a resistor 83 and a variable resistor 84 to advance the output voltage of the position detector 10, thereby stabilizing the speed control operation.

The deviation voltage generator 7 comprises a couple of differential amplifiers 62 and 63 and potentiometers 52 and 64. The deviation voltage generator has terminals 7*a* and 7*b* connected to the compensator circuit 6 and terminals 7*c* and 7*d* connected to the stabilizing circuit 11.

The deviation voltage generator 7 provides an output signal at the terminals 7*e* and 7*f* in accordance with the combination of the signals of the speed deviation generated by the deviation detector 200 and the position of the control rack. When the speed deviation signal indicates that an actual engine speed is below the set speed, and the other signal indicates that the control rack moves to increase the speed, the deviation voltage generator 7 generates the output voltage which is smaller than the voltage generated thereby without the position detector so that overshooting of the control rack is prevented. On the other hand, when an actual speed is detected above the set speed but the control rack still moves to increase the engine speed owing to its inertia, the deviation voltage generator 7 generates the output voltage which is larger than the voltage generated thereby without the position detector so that the control rack can be driven to decrease the engine speed more rapidly. By changing those potentiometers 52 and 64, a calibration can be made in a small range. For instance, the controlled rotational speed of the engine can be slightly changed by the potentiometers 52 and 54 without changing the matching frequency *fo*.

The differential amplifier 8 comprises a pair of transistors 85 and 86 and output terminals 8*a* and 8*b* for providing a pair of driving signals which are opposite to each other at the output terminals.

The power amplifying circuit 9 comprises a couple of single ended push-pull circuits to drive the servomotor 12 back and forth in response to the pair of drive signals of the differential amplifier 8. The servometer is connected across the output terminals 9*a* and 9*b* of the power amplifying circuit 9.

Numeral 150 is a voltage regulating circuit, which controls the voltage of a direct current source 160 to supply a regulated d·c voltage at its terminal E. Numeral 160′ is a negative voltage source connected to the multiplier 23 for supplying negative voltage thereto.

In operation, when the rotational speed of the engine is kept at a preset speed No, the speed sensor 1 generates the speed signal having the frequency fo which is equal to the matching frequency. As a result, the deviation voltage *Vm′* becomes zero, and, consequently, the output *Vo* of the power amplifier 9 becomes zero. In this instance, the servometer 12 is not driven, and the control rack of the fuel injection pump is kept in the same position as before.

When by reason of increasing a load on the engine or another, the engine rotational speed N decreases below No, the frequency of the speed signal f becomes smaller than fo and, consequently, the deviation voltage *Vm′* becomes larger than zero. As a result, the driving voltage Vo becomes larger than zero and the servomotor 12 is driven to move the control rack in the speed increasing direction.

When on the other hand, the engine rotational speed N increases above No, the frequency of the speed signal *f* becomes larger than *fo* and consequently, *Vm′* and then *Vo* become negative to drive the servomotor 12 in the opposite direction, thus, to move the control rack in the speed decreasing direction.

When the engine load change frequently the compensation circuit 6 and the stabilizing circuit 11 are effective to keep the engine speed change within a permissible limit. As in the embodiment herein disclosed, the deviation voltage generator 7, the differential amplifier 8 and the poweramplifier adopt the symmetric circuitry, the drift of the control voltages due to ambient temperature change is suppressed to a very law degree.

What is claimed is:

1. In combination:

an internal combustion engine; and an electric govenor for said internal combustion engine having means for controlling engine speed, said governor including:

a sensor generating an engine speed signal for frequency of which is proportional to the engine rotational speed;

means, connected to said sensor for shifting the phase of said engine speed signal;

a filter circuit having a preset frequency and connected to said sensor, said filter circuit varying its gain and the phase of said engine speed signal in response to the difference between the frequency of said engine speed signal and said preset frequency;

means, connected to said phase shifting means and said filter circuit, for generating a drive signal which is obtained by multiplying the outputs of said phase shifting means and said filter circuit; and means, connected to said multiplying means, for driving said speed control means in accordance with said drive signal.

2. In a combination as claimed in claim 1, wherein said phase shifting means comprises a twin-T type filter.

3. In a combination as claimed in claim 1, wherein said driving means comprises:

means for generating a position signal responsive to the position of said speed control means, means, connected to said multiplying means and said position signal generating means, for generating a pair of power signals with the phase opposite to each other in response to said drive signal and said position signal, and a servometer, connected to said power signal generating means, for driving said engine speed control means in response to the difference between said pair of power signals.

* * * * *